US009088089B2

(12) United States Patent
Huang et al.

(10) Patent No.: US 9,088,089 B2
(45) Date of Patent: Jul. 21, 2015

(54) POWER CONNECTOR ASSEMBLY

(71) Applicant: DELTA ELECTRONICS, INC., Taoyuan Hsien (TW)

(72) Inventors: Shin-I Huang, Taoyuan Hsien (TW); Yung-Hung Yang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 15 days.

(21) Appl. No.: 14/019,225

(22) Filed: Sep. 5, 2013

(65) Prior Publication Data

US 2014/0322947 A1 Oct. 30, 2014

(30) Foreign Application Priority Data

Apr. 26, 2013 (TW) ..... 102115182 A

(51) Int. Cl.

| | |
|---|---|
| ***H01R 4/50*** | (2006.01) |
| ***H01R 13/514*** | (2006.01) |
| ***H01R 13/04*** | (2006.01) |
| ***H01R 13/11*** | (2006.01) |

(52) U.S. Cl.

CPC ..... *H01R 13/514* (2013.01); *H01R 13/04* (2013.01); *H01R 13/113* (2013.01)

(58) Field of Classification Search

USPC ..... 439/345, 638, 686, 732; 320/109, 114
IPC ..... H01R 13/514,2201/26; Y02T 10/7088, Y02T 90/14
See application file for complete search history.

(56) References Cited

U.S. PATENT DOCUMENTS

| | | | | |
|---|---|---|---|---|
| 4,915,641 | A * | 4/1990 | Miskin et al. | 439/247 |
| 5,769,648 | A * | 6/1998 | Hayashi | 439/206 |
| 7,976,330 | B2 | 7/2011 | Lin | |
| 2009/0053937 | A1 * | 2/2009 | Tsou et al. | 439/638 |
| 2014/0273571 | A1 * | 9/2014 | Iyer et al. | 439/183 |

* cited by examiner

*Primary Examiner* — Vanessa Girardi
(74) *Attorney, Agent, or Firm* — Kirton McConkie; Evan R. Witt

(57) ABSTRACT

A power connector assembly includes a first electrical connector and a second electrical connector mating with the first electrical connector. The first electrical connector includes a plurality of first hollow tubes. Moreover, a plurality of first conducting terminals are disposed within the first hollow tubes, selectively. Each first conducting terminal has a flat contacting part. The second electrical connector includes a plurality of second hollow tubes corresponding to the first hollow tubes. Moreover, a plurality of second conducting terminals are disposed within the second hollow tubes, selectively. Each second conducting terminal has a terminal-clamping part. When the first electrical connector and the second electrical connector are combined together, the flat contacting part of each first conducting terminal is clamped by the terminal-clamping part of the corresponding second conducting terminal, so that electrical connection between the first electrical connector and the second electrical connector is established.

19 Claims, 6 Drawing Sheets

POWER CONNECTOR ASSEMBLY

FIELD OF THE INVENTION

The present invention relates to a power connector assembly, and more particularly to a power connector assembly having a reduced volume and having extensive applications.

BACKGROUND OF THE INVENTION

Recently, a power connector assembly has been widely used in a power network, a power transmission system, a power distribution system, a power supply system or an electrical device to be used as an interface of power transmission and connection. For example, a power supply system (e.g. a battery, a power supply or an uninterruptible power supply) and an electrical device (e.g. an industrial computer or a cloud data center) may be in communication with each other through two electrical connectors in order to achieve electrical connection and power transmission.

Conventionally, the power connector assembly comprises a first electrical connector and a second electrical connector. The first electrical connector may be connected with an electrical device through wires. The second electrical connector may be connected with an uninterruptible power supply through wires. Moreover, the first electrical connector comprises at most three cylindrical conducting terminals, and the second electrical connector comprises conducting terminals corresponding to the cylindrical conducting terminals of the first electrical connector. When the first electrical connector and the second electrical connector are combined together, the conducting terminals of the first electrical connector and the conducting terminals of the second electrical connector are electrically connected with each other. Consequently, electrical power can be transmitted through the first electrical connector and the second electrical connector.

With advancement of science and technology, many electrical devices and many power supply systems are developed toward high performance and miniaturization. In other words, it is important to reduce the volumes of the power supply system and the electrical device while increasing the capability of transmitting a higher current between the power supply system and the electrical device. However, since the conducting terminals of the first electrical connector of the conventional power connector assembly are cylindrical, the volume of the first electrical connector is larger, and it is difficult to minimize the conventional power connector assembly. Moreover, in case that the conventional power connector assembly is applied to the power supply system and the electrical device requiring higher electrical power, the conducting terminals of the first electrical connector and the conducting terminals of the second electrical connector should withstand a higher current. For complying with safety regulations, the conducting terminals of the first electrical connector and the conducting terminals of the second electrical connector should be made of the material that is capable of withstanding the higher current. Since this material is costly, the fabricating cost of the conventional power connector assembly is increased. Moreover, since each of the first electrical connector and the second electrical connector of the conventional power connector assembly has at most three conducting terminals, the conventional power connector assembly can only be applied to specified kinds of power supply systems and specified kinds of electrical devices. In other words, the applications of the conventional power connector assembly are restricted.

Therefore, there is a need of providing an improved power connector assembly in order to eliminate the above drawbacks.

SUMMARY OF THE INVENTION

The present invention provides a power connector assembly. The power connector assembly comprises a first electrical connector with plural first conducting terminals and a second electrical connector with plural second conducting terminals. The first conducting terminal has a flat contacting part. The second conducting terminal has a terminal-clamping part. The flat contacting part is clamped by the terminal-clamping part, so that electrical connection between the first electrical connector and the second electrical connector is established. Moreover, at least two first wires are connected with each other in parallel, so that the at least two first conducting terminals that are electrically connected with the parallel-connected first wires are connected with each other in parallel. Consequently, when compared with the conventional power connector assembly, the power connector assembly of the present invention has reduced volume. Moreover, the first conducting terminals and the second conducting terminals may be made of the cost-effective material that is capable of withstanding the lower current while complying with safety regulations. Since the power connector assembly of the present invention can be applied to the power supply system or the electrical device that requires higher electrical power, the applications of the power connector assembly are more extensive.

In accordance with an aspect of the present invention, there is provided a power connector assembly. The power connector assembly includes a first electrical connector and a second electrical connector mating with the first electrical connector. The first electrical connector includes a plurality of first hollow tubes. Moreover, a plurality of first conducting terminals are disposed within the first hollow tubes, selectively. Each first conducting terminal has a flat contacting part. The second electrical connector includes a plurality of second hollow tubes corresponding to the first hollow tubes. Moreover, a plurality of second conducting terminals are disposed within the second hollow tubes, selectively. Each second conducting terminal has a terminal-clamping part. When the first electrical connector and the second electrical connector are combined together, the flat contacting part of each first conducting terminal is clamped by the terminal-clamping part of the corresponding second conducting terminal, so that electrical connection between the first electrical connector and the second electrical connector is established.

In accordance with an aspect of the present invention, there is provided a power connector assembly. The power connector assembly includes a first electrical connector, a second electrical connector mating with the first electrical connector, and a plurality of first wires. The first electrical connector includes a plurality of first hollow tubes. Moreover, a plurality of first conducting terminals are disposed within the first hollow tubes, selectively. Each first conducting terminal has a flat contacting part. The second electrical connector includes a plurality of second hollow tubes corresponding to the first hollow tubes. Moreover, a plurality of second conducting terminals are disposed within the second hollow tubes, selectively. Each second conducting terminal has a terminal-clamping part for clamping the flat contacting part of the corresponding first conducting terminal, so that electrical connection between the first electrical connector and the second electrical connector is established. The plural first wires are electrically connected with the first conducting terminals, respectively. Moreover, at least two of the first wires are connected with each other in parallel, so that at least two of the first conducting terminals corresponding to the at least two parallel-connected first wires are connected with each other in parallel.

In accordance with an aspect of the present invention, there is provided a power connector assembly. The power connector assembly includes a first electrical connector and a second electrical connector mating with the first electrical connector. The first electrical connector includes a plurality of first hollow tubes. Moreover, a plurality of first conducting terminals are disposed within the first hollow tubes, selectively. Each first conducting terminal has a flat contacting part. The second electrical connector includes a plurality of second hollow tubes corresponding to the first hollow tubes. Moreover, a plurality of second conducting terminals are disposed within the second hollow tubes, selectively. Each second conducting terminal has a terminal-clamping part for clamping the flat contacting part of the corresponding first conducting terminal, so that electrical connection between the first electrical connector and the second electrical connector is established. Moreover, one of the first conducting terminals and the corresponding second conducting terminal are ground terminals. The first conducting terminal served as the ground terminal is longer than the other first conducting terminals and/or the second conducting terminal served as the ground terminal is longer than the other second conducting terminals.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
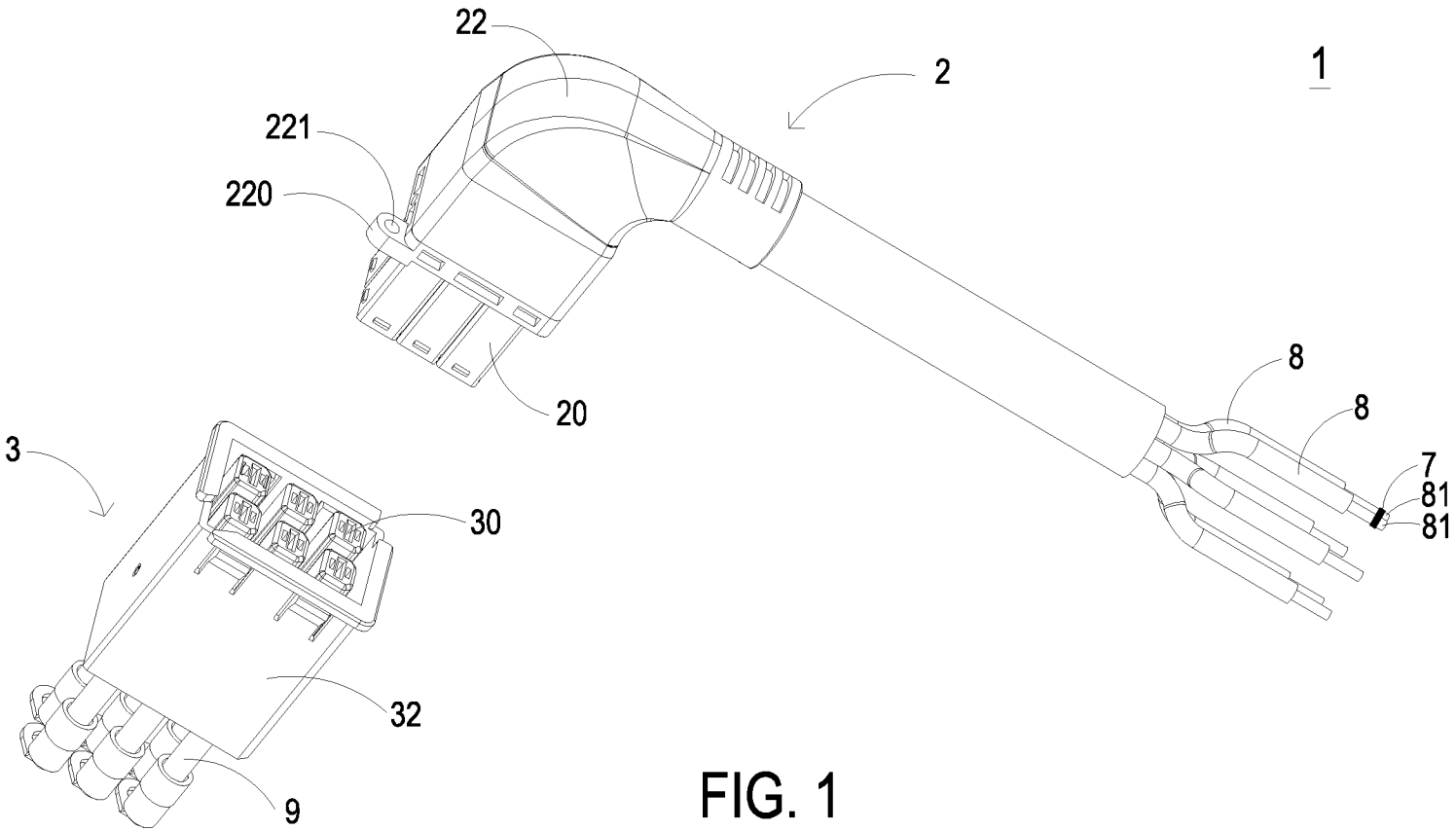
FIG. 1 is a schematic exploded view illustrating a power connector assembly according to an embodiment of the present invention.

FIG. 1 is a schematic exploded view illustrating a power connector assembly according to an embodiment of the present invention. As shown in FIG. 1, the power connector assembly 1 comprises a first electrical connector 2 and a second electrical connector 3, which mate with each other. The first electrical connector 2 may be electrically connected with an electrical device (not shown) such as an industrial computer or a cloud data center. The second electrical connector 3 may be electrically connected with a power supply system (not shown) such as a battery, a power supply or an uninterruptible power supply. After the first electrical connector 2 and the second electrical connector 3 are combined together, the power supply system and the electrical device are electrically connected with each other through the power connector assembly 1. It is noted that the devices to be electrically connected with each other through the first electrical connector 2 and the second electrical connector 3 are not restricted. That is, the devices to be electrically connected with each other through the first electrical connector 2 and the second electrical connector 3 may be varied according to the practical requirements. For example, in some other embodiments, the first electrical connector 2 is electrically connected with a power supply system, and the second electrical connector 3 is electrically connected with an electrical device. In the following embodiments, the present invention will be illustrated by referring to the power connector assembly 1 including the first electrical connector 2 and the second electrical connector 3, wherein the first electrical connector 2 is electrically connected with an electrical device and the second electrical connector 3 is electrically connected with a power supply system.

Figure 2:
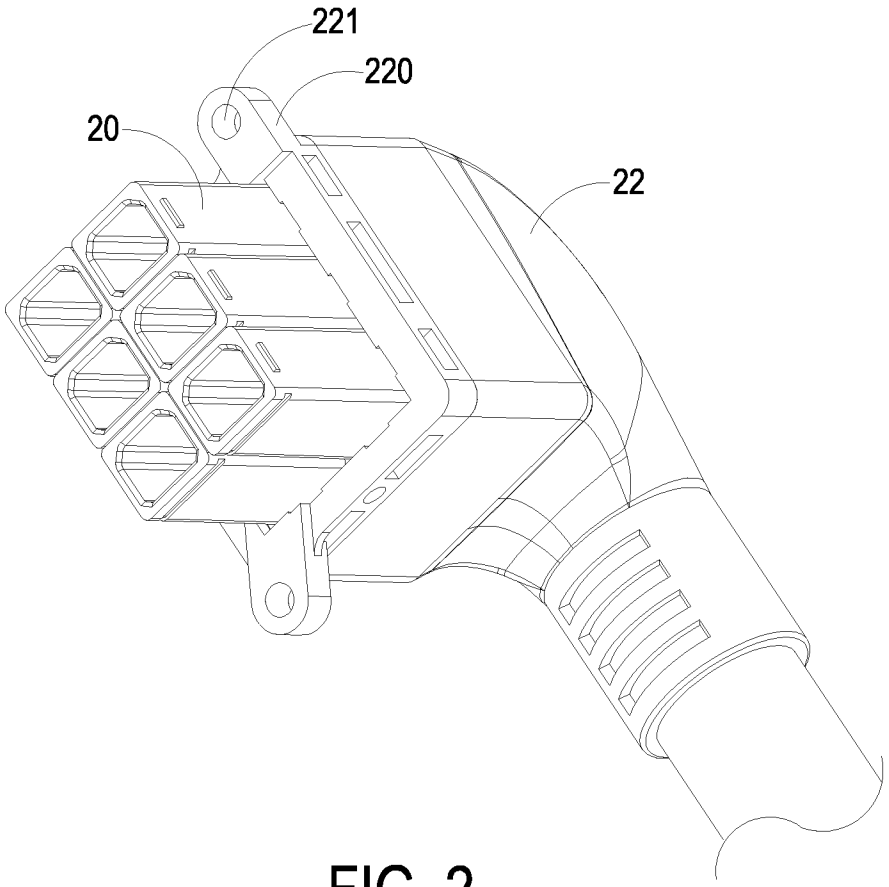
FIG. 2 is a schematic perspective view illustrating the first electrical connector of the power connector assembly of FIG. 1 and taken along a specified viewpoint.
Figure 3:
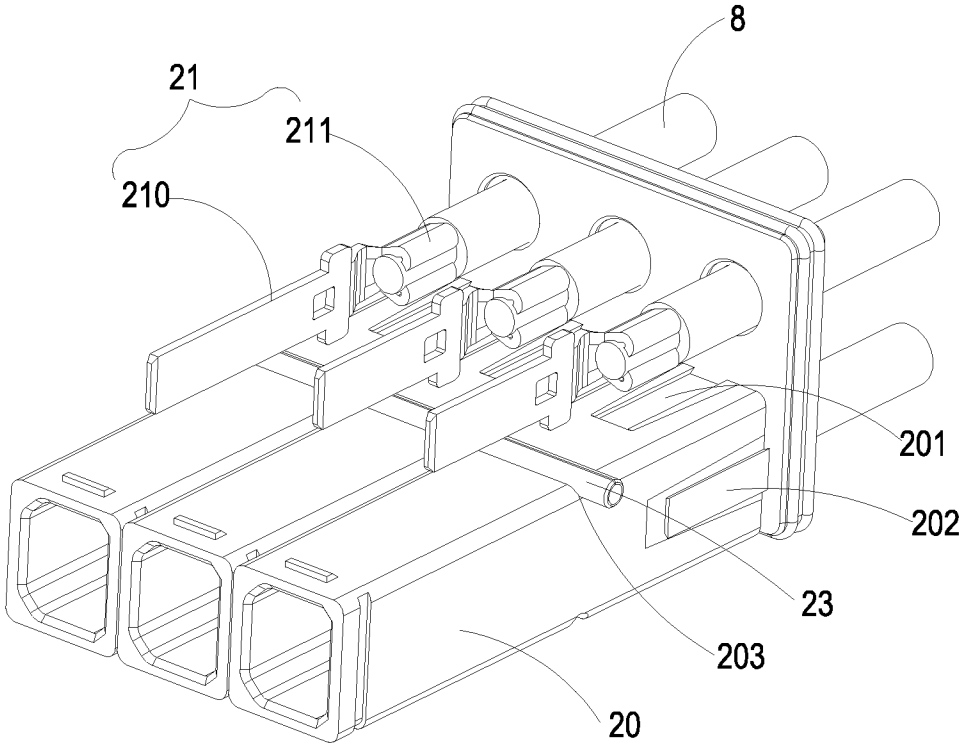
FIG. 3 is a schematic perspective view illustrating the inner structure of the first electrical connector of the power connector assembly of FIG. 1.

FIG. 2 is a schematic perspective view illustrating the first electrical connector of the power connector assembly of FIG. 1 and taken along a specified viewpoint. FIG. 3 is a schematic perspective view illustrating the inner structure of the first electrical connector of the power connector assembly of FIG. 1. As shown in FIGS. 2 and 3, the first electrical connector 2 comprises plural first hollow tubes 20. The plural first hollow tubes 20 are arranged side by side. Moreover, the plural first hollow tubes 20 are made of an insulating material. Moreover, plural first conducting terminals 21 are disposed within the corresponding first hollow tubes 20, selectively. The first conducting terminal 21 is made of a conductive material such as a metallic material. Moreover, each first conducting terminal 21 has a flat contacting part 210. The flat contacting part 210 has an elongated strip-like structure.

In this embodiment, the first electrical connector 2 further comprises plural first wires 8 corresponding to the plural first conducting terminals 21, respectively. Moreover, each first conducting terminal 21 further comprises a first wire-clamping part 211. The plural first wires 8 may be connected with the electrical device for transmitting electrical energy. The first wire-clamping part 211 is connected with a corresponding flat contacting part 210 in order to clamp the corresponding first wire 8. Consequently, the flat contacting part 210, the corresponding first wire-clamping part 211 and the corresponding first wire 8 are electrically connected with each other.

Figure 4:
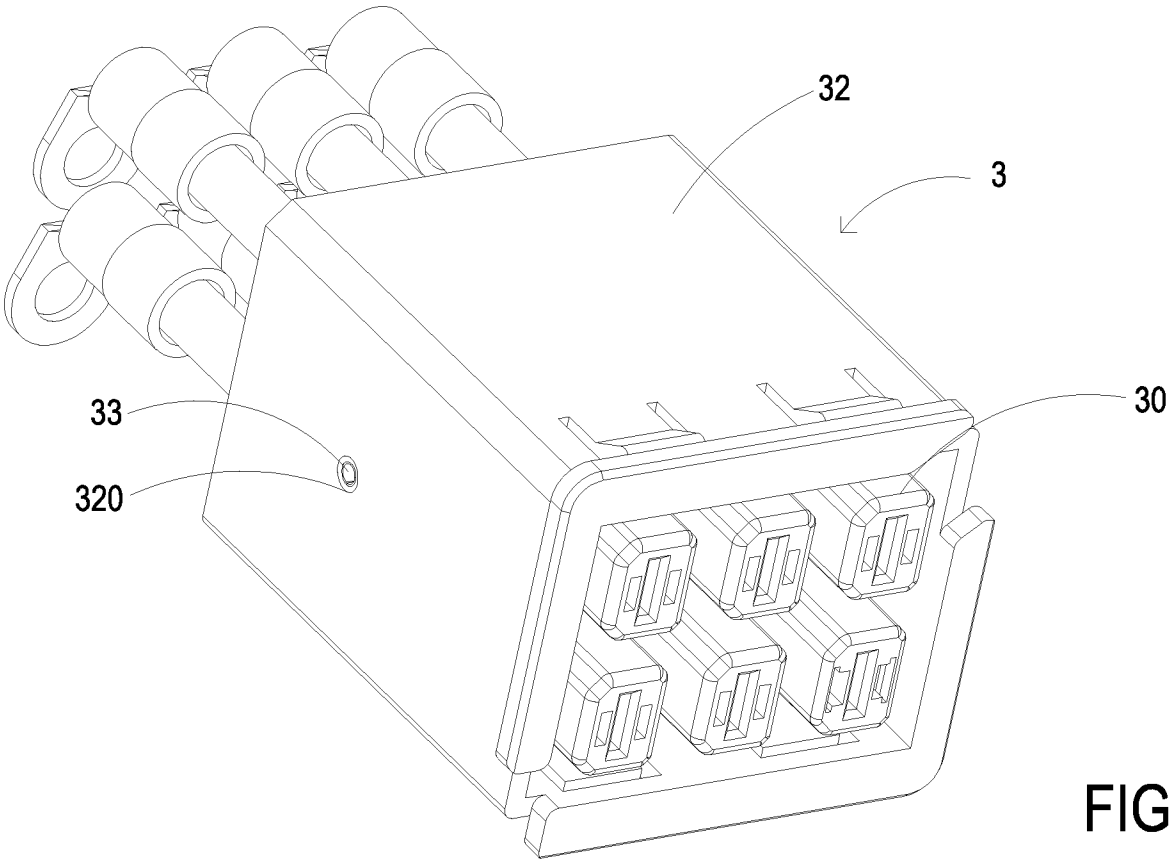
FIG. 4 is a schematic perspective view illustrating the second electrical connector of the power connector assembly of FIG. 1 and taken along a specified viewpoint.
Figure 5:
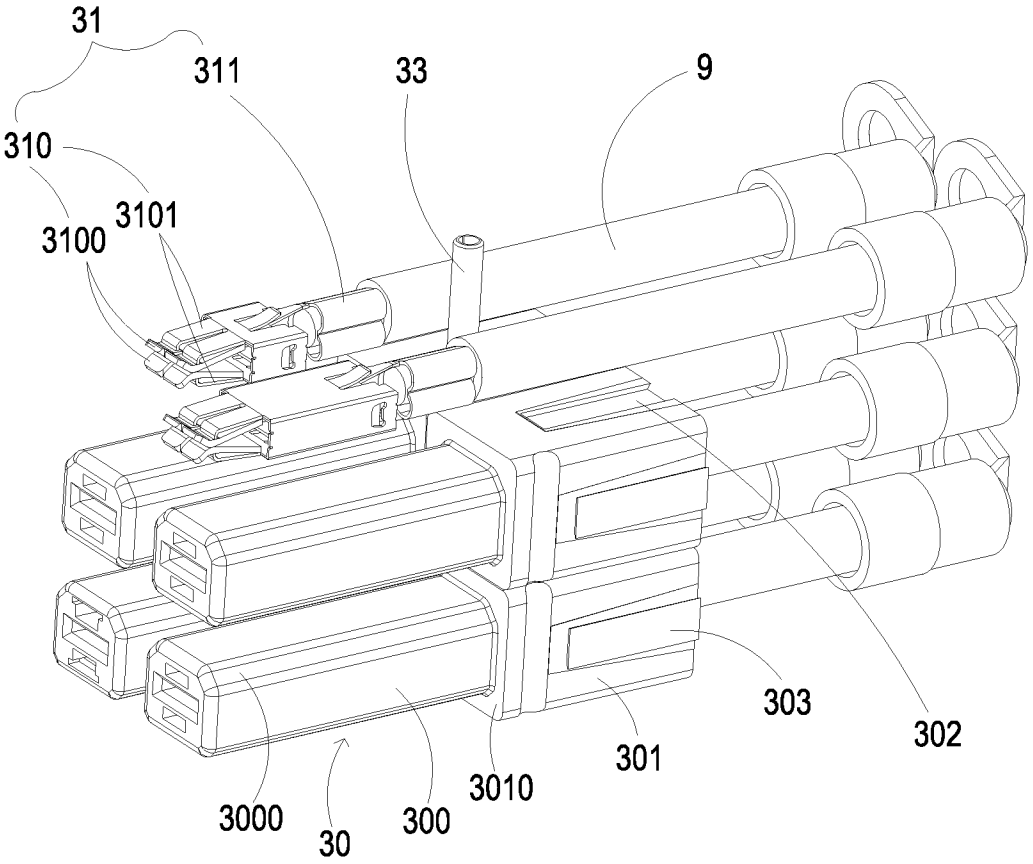
FIG. 5 is a schematic perspective view illustrating the inner structure of the second electrical connector of the power connector assembly of FIG. 1.

FIG. 4 is a schematic perspective view illustrating the second electrical connector of the power connector assembly of FIG. 1 and taken along a specified viewpoint. FIG. 5 is a schematic perspective view illustrating the inner structure of the second electrical connector of the power connector assembly of FIG. 1. Please refer to FIGS. 1-5. The second electrical connector 3 comprises plural second hollow tubes 30 corresponding to the plural first hollow tubes 20. The plural second hollow tubes 30 are arranged side by side. Moreover, the plural second hollow tubes 30 are made of an insulating material. Moreover, plural second conducting terminals 31 are disposed within the corresponding second hollow tubes 30, selectively. The second conducting terminal 31 is made of a conductive material such as a metallic material.

Moreover, each second conducting terminal 31 has a terminal-clamping part 310. When the first electrical connector 2 and the second electrical connector 3 are combined together, the flat contacting part 210 of each first conducting terminal 21 is clamped by the terminal-clamping part 310 of the corresponding second conducting terminal 31. Consequently, the electrical connection between the first electrical connector 2 and the second electrical connector 3 is established.

As previously described, since the conducting terminals of the first electrical connector of the conventional power connector assembly are cylindrical, the volume of the first electrical connector is larger. In other words, it is difficult to minimize the conventional power connector assembly. Since the flat contacting part 210 of the first conducting terminal 21 and the terminal-clamping part 310 of the second conducting terminal 31 are smaller, the power connector assembly 1 of the present invention can meet the miniaturization requirement. Moreover, since the plural first conducting terminals 21 of the first electrical connector 2 and the plural second conducting terminals 31 of the second electrical connector 3 are respectively disposed within corresponding first hollow tubes 20 and corresponding second hollow tubes 30, the plural first conducting terminals 21 and the plural second conducting terminals 31 are isolated from each other by the first hollow tubes 20 and the second hollow tubes 30. Under this circumstance, the creepage distance between the plural first conducting terminals 21 and the creepage distance between the plural second conducting terminals 31 will be increased, and the safety of the power connector assembly 1 will be enhanced.

In this embodiment, the second electrical connector 3 further comprises plural second wires 9 corresponding to the plural second conducting terminals 31, respectively. Moreover, each second conducting terminal 31 further comprises a second wire-clamping part 311. The plural second wires 9 may be connected with the power supply system for transmitting electrical energy. The second wire-clamping part 311 is connected with a corresponding terminal-clamping part 310 in order to clamp the corresponding second wire 9. Consequently, the terminal-clamping part 310, the corresponding second wire-clamping part 311 and the corresponding second wire 9 are electrically connected with each other.

Moreover, the first conducting terminal 21 may be shorter than the first hollow tube 20, and the second conducting terminal 31 may be shorter than the second hollow tube 30. Consequently, the first conducting terminal 21 and the second conducting terminal 31 are protected by the first hollow tube 20 and the second hollow tube 30, respectively.

Please refer to FIGS. 1 and 2 again. In some other embodiments, the first electrical connector 2 further comprises a sheltering part 22 for sheltering a portion of the plural first hollow tube 20 and the plural first wires 8. The sheltering part 22 is produced by a plastic molding process. Moreover, the sheltering part 22 is made of an insulating material. The sheltering part 22 may fix the plural first hollow tubes 20. Since the sheltering part 22 may be handheld, the sheltering part 22 may facilitate the user to operate the first electrical connector 2. Moreover, since the sheltering part 22 is made of the insulating material, the safety of the first electrical connector 2 is enhanced. Moreover, at least one locking part 220 is extended from the sheltering part 22. The locking part 220 has a screwing hole 221. After the first electrical connector 2 and the second electrical connector 3 are combined together, a screw (not shown) may be penetrated through the screwing hole 221 and tightened into a corresponding screwing hole (not shown) of the power supply system that is connected with the second electrical connector 3. Consequently, the first electrical connector 2 is fixed on the power supply system.

Please refer to FIG. 1 again. In some other embodiments, the outlets 81 of at least two first wires 8 are connected with each other in parallel, and connected to a contact point (not shown) of the electrical device. Moreover, the outlets 81 of the parallel-connected first wires 8 are connected with each other through solder paste 7. Consequently, the at least two first conducting terminals 21 that are electrically connected with the parallel-connected first wires 8 are connected with each other in parallel. Moreover, a current may be transmitted to the contact point of the electrical device through the parallel-connected first conducting terminals 21 and the parallel-connected first wires 8. Since at least two first conducting terminals 21 may be connected with each other in parallel, the contact point of the electrical device can receive a higher current while each first conducting terminal 21 is able to withstand a lower current. Under this circumstance, the first conducting terminal 21 is cost-effective, and the fabricating cost of the power connector assembly 1 is reduced. For example, it is assumed that a current of 50 amperes needs to be transmitted to the contact point of the electrical device. If none of the first conducting terminals 21 are connected with each other in parallel, each first conducting terminal should withstand the current of 50 amperes. On the other hand, if two first conducting terminals 21 are connected with each other in parallel, each first conducting terminal 21 should withstand the current of only 25 amperes. Since each first conducting terminal 21 may be made of the material with a lower withstand current, the fabricating cost of the power connector assembly 1 is reduced. Moreover, if each first conducting terminal 21 is able to withstand a current of 50 amperes, the contact point of the electrical device can receive a current of 100 amperes through the two parallel-connected first conducting terminals 21. On the other hand, since none of the conducting terminals of the first electrical connector of the conventional power connector assembly are connected with each other in parallel, the contact point of the electrical device can receive a current of 50 amperes through the corresponding conducting terminal. In other words, the power connector assembly 1 of the present invention can be applied to the power supply system or the electrical device that requires higher electrical power. Consequently, the applications of the power connector assembly 1 are more extensive.

It is preferred that the first electrical connector 2 has six first conducting terminals 21 and the second electrical connector 3 has six second conducting terminals 31 (see FIG. 1). Consequently, the first electrical connector 2 and the second electrical connector 3 of the power connector assembly 1 can be applied to the power supply system or the electrical device that requires higher electrical power. If the power connector assembly 1 has too many first conducting terminals 21 and too many second conducting terminals 31, the overall volume of the power connector assembly 1 is relatively large. As previously described, each of the first electrical connector and the second electrical connector of the conventional power connector assembly has at most three conducting terminals, the conventional power connector assembly can be applied to specified kinds of power supply systems and specified kinds of electrical devices. In other words, the applications of the conventional power connector assembly are restricted. Since the power connector assembly 1 of the present invention can be applied to more kinds of power supply system and more kinds of electrical devices, the applications of the power connector assembly 1 are more extensive.

It is noted that the first electrical connector 2 may have more or less than six first conducting terminals 21 and the second electrical connector 3 may have more or less than six second conducting terminals 31. If the first electrical connector 2 has more than six first conducting terminals 21 and the second electrical connector 3 has more or less than six second conducting terminals 31, the withstand current and the withstand temperature of the first electrical connector 2 and the second electrical connector 3 should be taken into consideration. Moreover, corresponding to the six first conducting terminals 21 and the six second conducting terminals 31, it is preferred that the first electrical connector 2 has six first hollow tubes 20 and the second electrical connector 3 has six second hollow tubes 30. More especially, according to the practical requirements, the number of the first hollow tubes 20 may be greater than the number of the first conducting terminals 21, and the number of the second hollow tubes 30 may be greater than the number of the second conducting terminals 31.

Please refer to FIGS. 3 and 5. In some embodiments, one of the plural first conducting terminals 21 and the corresponding second conducting terminal 31 are ground terminals. Moreover, the first conducting terminal 21 served as the ground terminal is longer than the other first conducting terminals 21, and/or the second conducting terminal 31 served as the ground terminal is longer than the other second conducting terminal 31. For example, the left first conducting terminal 21 as shown in FIG. 3 may be served as a ground terminal and longer than the other first conducting terminals 21. Moreover, the right second conducting terminal 31 as shown in FIG. 5 may be served as a ground terminal and longer than the other second conducting terminals 31. Consequently, during the process of assembling the first electrical connector 2 with the second electrical connector 3, the first conducting terminal 21 served as the ground terminal and the second conducting terminal 31 served as the ground terminal are contacted with each other at the time point earlier than the contact between any other first conducting terminal 21 and any other second conducting terminal 31. Under this circumstance, the safety of the power connector assembly 1 is enhanced.

Figure 6:
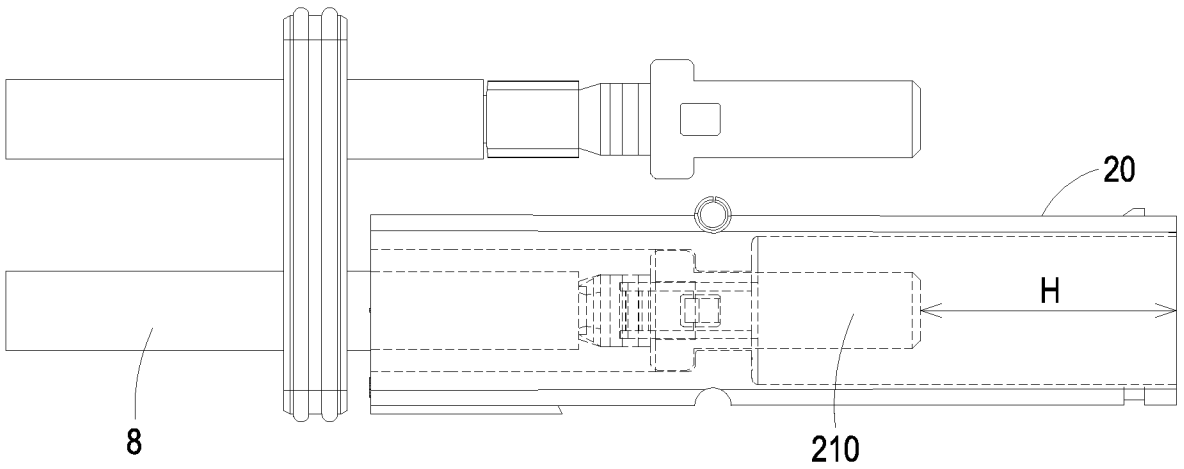
FIG. 6 is a schematic cross-sectional view illustrating the first electrical connector of the power connector assembly of FIG. 3.

FIG. 6 is a schematic cross-sectional view illustrating the first electrical connector of the power connector assembly of FIG. 3. For preventing the user's finger from being directly contacted with the first conducting terminal 21 within the first hollow tube 20, a tip of the first conducting terminal 21 is separated from an entrance of the first hollow tube 20 by a safe distance H. For example, the safe distance H is the range between 15 mm and 16 mm. Moreover, if the first conducting terminal 21 is served as the ground terminal and longer than the other first conducting terminals 21, the tip of the safe distance H between the ground terminal and the entrance of the first hollow tube 20 is in the range between 15 mm and 15.5 mm. Similarly, a tip of the second conducting terminal 31 is separated from an entrance of the second hollow tube 30 by a safe distance (not shown).

Please refer to FIGS. 3 and 5 again. In some other embodiments, the first hollow tube 20 further comprises a first coupling part 201 and a second coupling part 202, and the second hollow tube 30 further comprises a first coupling part 302 and a second coupling part 303. For example, the first coupling parts 201 and 302 are concave structures, and the second coupling parts 202 and 303 are convex structures. The first coupling part 201 of each first hollow tube 20 is engaged with the second coupling part 202 of an adjacent first hollow tube 20. Similarly, the first coupling part 302 of each second hollow tube 30 is engaged with the second coupling part 303 of an adjacent second hollow tube 30. Due to the engagement between the first coupling parts 201, 302 and the second coupling parts 202, 303, the number of the first hollow tubes 20 of the first electrical connector 2 and the number of the second hollow tubes 30 of the second electrical connector 3 can be expanded. In other words, the number of the first conducting terminals 21 within the first hollow tubes 20 and the number of the second conducting terminal 31 within the second hollow tubes 30 can be expanded.

Please refer to FIG. 5. In some embodiments, the terminal-clamping part 310 further comprises two elastic structures 3100 and two sustaining structures 3101. The two elastic structures 3100 are located beside and contacted with each other for providing an elastic force. During the process of assembling the first electrical connector 2 and the second electrical connector 3, the two elastic structures 3100 are separated by the flat contacting part 210 of the first conducting terminal 21 of the first electrical connector 2, and thus the flat contacting part 210 of the first conducting terminal 21 is interposed into the space between the two elastic structures 3100. Under this circumstance, the flat contacting part 210 of the first conducting terminal 21 is clamped by the two elastic structures 3100, respectively. Moreover, during the process of detaching the first electrical connector 2 from the second electrical connector 3, the flat contacting part 210 of the first conducting terminal 21 is withdrawn from the space between the two elastic structures 3100. In response to the elastic restoring force of the two elastic structures 3100, the two elastic structures 3100 are returned to their original positions and contacted with each other again. Moreover, the two sustaining structures 3101 are located at the outer sides of the corresponding elastic structures 3100 and contacted with the corresponding elastic structures 3100, respectively. Since the sustaining structures 3101 are sustained against the corresponding elastic structures 3100, the elastic structures 3100 can clamp the flat contacting part 210 of the first conducting terminal 21 more firmly.

Moreover, in some embodiments, each second hollow tube 30 further comprises a first main body 300 and a second main body 301. The first main body 300 is perpendicularly protruded from an inner periphery of an end surface 3010 of the second main body 301. In other words, the cross-section area of the first main body 300 is smaller than the cross-section area of the second main body 301. Moreover, the first main body 300 and the second main body 301 are in communication with each other. Moreover, the size and the shape of the first main body 300 match the size and the shape of the hollow structure of the first hollow tube 20. Consequently, when the first electrical connector 2 and the second electrical connector 3 are combined together, the first main body 300 is accommodated within the hollow structure of the first hollow tube 20, and a portion of the end surface 3010 of the second main body 301 of the second hollow tube 30 is contacted with the corresponding first hollow tube 20. Moreover, since the end surface 3010 of the second main body 301 is partially contacted with the first hollow tube 20 when the first electrical connector 2 and the second electrical connector 3, the possibility of exerting an improper force to assemble the first electrical connector 2 with the second electrical connector 3 will be minimized. In other words, the possibility of damaging the first electrical connector 2 with the second electrical connector 3 will be minimized. Moreover, an outer surface of the first main body 300 has at least one beveled structure 3000. The beveled structure 3000 may reduce the volume of the first main body 300 in order to correspondingly reduce the volume of the second electrical connector 3. Moreover, since the size and the shape of the first main body 300 match the size and the shape of the hollow structure of the first hollow tube 20, the beveled structure 3000 on the outer surface of the first main body 300 may be used as a foolproof structure. Consequently, the first main body 300 can be inserted into the hollow structure of the first hollow tube 20 in a foolproof manner.

In some embodiments, the first electrical connector 2 further comprises a first rib 23. Moreover, corresponding to the first rib 23, plural fixing recesses 203 are formed in some of the first hollow tubes 20. The first rib 23 is a strip-like structure, but is not limited thereto. The plural fixing recesses 203 are aligned with the first rib 23 for accommodating a portion of the first rib 23. Consequently, the first rib 23 can facilitate the connection between the plural first hollow tubes 20.

Please refer to FIGS. 1, 4 and 5. In some other embodiments, the second electrical connector 3 further comprises an external casing 32 and a second rib 33. The external casing 32 is used for covering the plural second hollow tubes 30. The second rib 33 is a strip-like structure, but is not limited thereto. The second rib 33 is disposed within the external casing 32. The two ends of the second rib 33 are embedded into two openings 320 at two opposite surfaces of the external casing 32. After the plural second hollow tubes 30 are covered by the external casing 32, the external casing 32 is positioned by the second rib 33. Similarly, the second rib 33 may be accommodated within plural fixing recesses (not shown) of some of the second hollow tubes 30 in order to facilitate the connection between the plural second hollow tubes 30.

From the above descriptions, the present invention provides a power connector assembly. The power connector assembly comprises a first electrical connector with plural first conducting terminals and a second electrical connector with plural second conducting terminals. The first conducting terminal has a flat contacting part. The second conducting terminal has a terminal-clamping part for clamping the flat contacting part. Consequently, the volumes of the first electrical connector and the second electrical connector are reduced when compared with the conventional power connector assembly. Moreover, since at least two first wires are connected with each other in parallel, the at least two first conducting terminals that are electrically connected with the parallel-connected first wires are connected with each other in parallel. Consequently, the first conducting terminals and the second conducting terminals may be made of the material that is capable of withstanding the lower current while complying with safety regulations. Under this circumstance, the fabricating cost of the power connector assembly is reduced. Since the power connector assembly of the present invention can be applied to the power supply system or the electrical device that requires higher electrical power, the applications of the power connector assembly are more extensive. Moreover, since the first electrical connector has six first conducting terminals and the second electrical connector has six second conducting terminals, the applications of the power connector assembly is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power connector assembly, comprising:

a first electrical connector comprising a plurality of first hollow tubes, wherein a plurality of first conducting terminals are disposed within said first hollow tubes, selectively, wherein each first conducting terminal has a flat contacting part; and a second electrical connector mating with said first electrical connector, and comprising a plurality of second hollow tubes corresponding to said first hollow tubes, wherein a plurality of second conducting terminals are disposed within said second hollow tubes, selectively, wherein each second conducting terminal has a terminal-clamping part, wherein when said first electrical connector and said second electrical connector are combined together, said flat contacting part of each first conducting terminal is clamped by said terminal-clamping part of said corresponding second conducting terminal, so that electrical connection between said first electrical connector and said second electrical connector is established;

wherein said terminal-clamping part of said second conducting terminal further comprises:

two elastic structures are located beside and contacted with each other, wherein during said first electrical connector and said second electrical connector are assembled with each other, said two elastic structures are separated by said flat contacting part and said flat contacting part is interposed into a space between said two elastic structures, so that said flat contacting part is clamped by said two elastic structures; and two sustaining structures, wherein said two sustaining structures are located at outer sides of said elastic structures and contacted with said two elastic structures, respectively.

2. The power connector assembly according to claim 1, wherein said first electrical connector comprises six first hollow tubes and six first conducting terminals, and said second electrical connector comprises six second hollow tubes and six second conducting terminals.

3. The power connector assembly according to claim 1, wherein said first electrical connector further comprises:

a sheltering part for sheltering a portion of said first hollow tube; and at least one locking part is extended from said sheltering part, and said locking part has a screwing hole.

4. The power connector assembly according to claim 1, wherein said first electrical connector further comprises a first rib, and a fixing recess is formed in an outer surface of said first hollow tube corresponding to said first rib, wherein a portion of said first rib is accommodated within said fixing recess.

5. The power connector assembly according to claim 1, wherein said second electrical connector further comprises an external casing for covering said second hollow tubes.

6. The power connector assembly according to claim 1, wherein said first conducting terminal is shorter than said corresponding first hollow tube, and said second conducting terminal is shorter than said corresponding second hollow tube.

7. The power connector assembly according to claim 1, wherein one of said first conducting terminals is longer than the other first conducting terminals or one of said second conducting terminals is longer than the other second conducting terminals, wherein one of said first conducting terminals and said corresponding second conducting terminal are ground terminals.

8. The power connector assembly according to claim 1, wherein a tip of said first conducting terminal is separated from an entrance of said first hollow tube by a safety distance.

9. The power connector assembly according to claim 1, wherein said first electrical connector further comprises a plurality of first wires, wherein each first wire is electrically connected with said corresponding first conducting terminal, wherein each first conducting terminal further comprises a first wire-clamping part for clamping said corresponding first wire, and said first wire-clamping part is connected with said flat contacting part.

10. The power connector assembly according to claim 9, wherein at least two of said first wires are connected with each other in parallel, so that at least two of said first conducting terminals corresponding to said at least two parallel-connected first wires are connected with each other in parallel.

11. The power connector assembly according to claim 1, wherein said second electrical connector further comprises a plurality of second wires, wherein each second wire is electrically connected with said corresponding second conducting terminal.

12. The power connector assembly according to claim 11, wherein each second conducting terminal further comprises a second wire-clamping part for clamping said corresponding second wire, and said second wire-clamping part is connected with said terminal-clamping part.

13. The power connector assembly according to claim 1, wherein each of said first hollow tube and said second hollow tube further comprises a first coupling part and a second coupling part, wherein said first coupling part of each first hollow tube is engaged with said second coupling part of an adjacent first hollow tube, so that said first hollow tubes are combined together, wherein said first coupling part of each second hollow tube is engaged with said second coupling part of an adjacent second hollow tube, so that said second hollow tubes are combined together.

14. The power connector assembly according to claim 13, wherein said first coupling part is a concave structure, and said second coupling part is a convex structure.

15. The power connector assembly according to claim 1, wherein each second hollow tube further comprises a first main body and a second main body, wherein said first main body is perpendicularly protruded from an inner periphery of an end surface of said second main body, and said first main body and said second main body are in communication with each other.

16. The power connector assembly according to claim 15, wherein a size and a shape of said first main body match a size and a shape of a hollow structure of said first hollow tube, wherein when said first electrical connector and said second electrical connector are combined together, said first main body is accommodated within said hollow structure of said first hollow tube, and a portion of said end surface of said second main body of said second hollow tube is contacted with said first hollow tube.

17. The power connector assembly according to claim 15, wherein an outer surface of said first main body has at least one beveled structure.

18. A power connector assembly, comprising:

a first electrical connector comprising a plurality of first hollow tubes, wherein a plurality of first conducting terminals are disposed within said first hollow tubes, selectively, wherein each first conducting terminal has a flat contacting part;

a second electrical connector mating with said first electrical connector, and comprising a plurality of second hollow tubes corresponding to said first hollow tubes, wherein a plurality of second conducting terminals are disposed within said second hollow tubes, selectively, wherein each second conducting terminal has a terminal-clamping part for clamping said flat contacting part of said corresponding first conducting terminal, so that electrical connection between said first electrical connector and said second electrical connector is established; and a plurality of first wires electrically connected with said first conducting terminals, respectively, wherein at least two of said first wires are connected with each other in parallel, so that at least two of said first conducting terminals corresponding to said at least two parallel-connected first wires are connected with each other in parallel;

wherein said terminal-clamping part of said second conducting terminal further comprises:

two elastic structures are located beside and contacted with each other, wherein during said first electrical connector and said second electrical connector are assembled with each other, said two elastic structures are separated by said flat contacting part and said flat contacting part is interposed into a space between said two elastic structures, so that said flat contacting part is clamped by said two elastic structures; and two sustaining structures, wherein said two sustaining structures are located at outer sides of said elastic structures and contacted with said two elastic structures, respectively.

19. A power connector assembly, comprising:

a first electrical connector comprising a plurality of first hollow tubes, wherein a plurality of first conducting terminals are disposed within said first hollow tubes, selectively, wherein each first conducting terminal has a flat contacting part; and a second electrical connector mating with said first electrical connector, and comprising a plurality of second hollow tubes corresponding to said first hollow tubes, wherein a plurality of second conducting terminals are disposed within said second hollow tubes, selectively, wherein each second conducting terminal has a terminal-clamping part for clamping said flat contacting part of said corresponding first conducting terminal, so that electrical connection between said first electrical connector and said second electrical connector is established, wherein one of said first conducting terminals and said corresponding second conducting terminal are ground terminals, wherein said first conducting terminal served as said ground terminal is longer than the other first conducting terminals or said second conducting terminal served as said ground terminal is longer than the other second conducting terminals;

wherein said terminal-clamping part of said second conducting terminal further comprises:

two elastic structures are located beside and contacted with each other, wherein during said first electrical connector and said second electrical connector are assembled with each other, said two elastic structures are separated by said flat contacting part and said flat contacting part is interposed into a space between said two elastic structures, so that said flat contacting part is clamped by said two elastic structures; and two sustaining structures, wherein said two sustaining structures are located at outer sides of said elastic structures and contacted with said two elastic structures, respectively.

* * * * *